US007537137B2

(12) United States Patent
Giraud

(10) Patent No.: US 7,537,137 B2
(45) **Date of Patent: *May 26, 2009**

(54) RESEALABLE MOISTURE TIGHT CONTAINER ASSEMBLY FOR STRIPS AND THE LIKE HAVING A LIP SNAP SEAL

(75) Inventor: Jean-Pierre Giraud, Paris (FR)

(73) Assignee: CSP Technologies, Inc., Amsterdam, NY (US)

( * ) Notice: Subject to any disclaimer, the term of this patent is extended or adjusted under 35 U.S.C. 154(b) by 92 days.

This patent is subject to a terminal disclaimer.

(21) Appl. No.: 11/171,171

(22) Filed: Jun. 30, 2005

(65) Prior Publication Data

US 2005/0258174 A1 Nov. 24, 2005

Related U.S. Application Data

(63) Continuation-in-part of application No. 10/683,311, filed on Oct. 10, 2003, now Pat. No. 7,213,720.

(60) Provisional application No. 60/417,533, filed on Oct. 10, 2002.

(51) Int. Cl.

| | |
|---|---|
| ***B65D 43/18*** | (2006.01) |
| ***B65D 8/18*** | (2006.01) |
| *B65D 83/08* | (2006.01) |
| *B65D 83/04* | (2006.01) |
| *B65H 1/00* | (2006.01) |

(52) U.S. Cl. ..... 220/839; 220/4.23; 220/4.21; 220/259.1; 220/254.3; 206/535; 221/45

(58) Field of Classification Search ..... 215/341, 215/354, 235, 343, 344; 220/847, 601, 661, 220/259.1, 4.21, 4.23, 839, 837, 254.3, 254.7, 220/254.1, 256.1; 206/535, 204, 524.1, 524.4; 221/63, 45

See application file for complete search history.

(56) References Cited

U.S. PATENT DOCUMENTS

| | | | | |
|---|---|---|---|---|
| 3,967,756 | A * | 7/1976 | Barish | 221/45 |
| 4,036,360 | A * | 7/1977 | Deffeyes | 206/204 |
| 4,964,539 | A * | 10/1990 | Mueller | 222/94 |
| 5,145,646 | A * | 9/1992 | Tyranski | 422/102 |
| 5,699,912 | A * | 12/1997 | Ishikawa et al. | 206/494 |
| 6,080,350 | A * | 6/2000 | Hekal | 264/255 |
| 6,951,292 | B2 * | 10/2005 | Bando et al. | 220/254.5 |
| 7,213,720 | B2 * | 5/2007 | Giraud | 220/839 |
| 2004/0173612 | A1 * | 9/2004 | Giraud | 220/259.1 |

* cited by examiner

*Primary Examiner*—Robin Hylton
(74) *Attorney, Agent, or Firm*—Greenberg Traurig, LLP

(57) ABSTRACT

A substantially moisture tight container and lid assembly for storing and packaging moisture-sensitive items comprising an assembly with a container and a lid, the lid is attached by a hinge to an upper housing portion of the container, the lid includes a lip seal member that extends downwardly from the lid, the lip seal member is configured to abut at least a portion of the interior side of the container when the lid is in the closed position resulting in a substantially moisture tight seal between the lid and the lid, and the container assembly further comprising a base portion and an upper housing portion, the upper housing portion is capable of being snap-fit into the base portion by employing a lip seal mechanism to form a substantially moisture-tight seal.

7 Claims, 10 Drawing Sheets

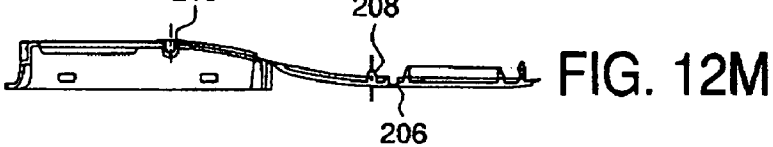
FIG. 12M
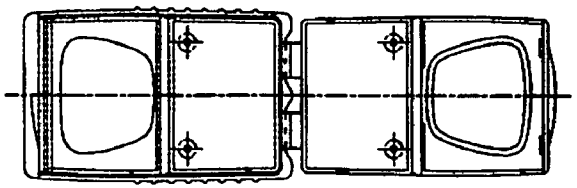
FIG. 12N
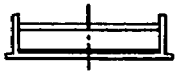
FIG. 12J
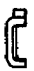
FIG. 12D
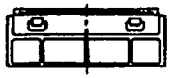
FIG. 12A
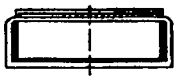
FIG. 12B
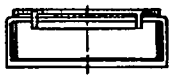
FIG. 12C
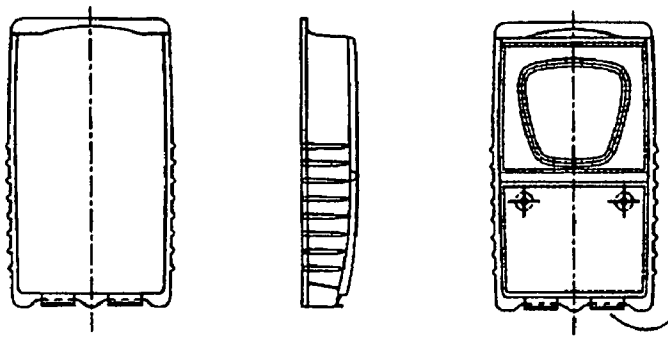
FIG. 12E
FIG. 12F
FIG. 12G
FIG. 12H
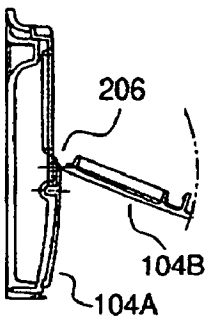
FIG. 12I
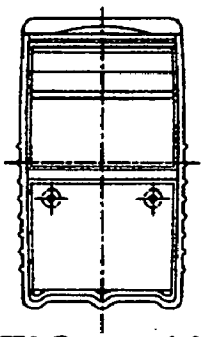
FIG. 12K
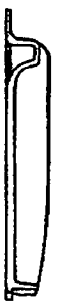
FIG. 12L

RESEALABLE MOISTURE TIGHT CONTAINER ASSEMBLY FOR STRIPS AND THE LIKE HAVING A LIP SNAP SEAL

CROSS-REFERENCE TO RELATED APPLICATIONS

This application is a continuation-in-part of U.S. application Ser. No. 10/683,311, filed Oct. 10, 2003 now U.S. Pat. No. 7,213,720, which claims a benefit under 35 U.S.C. 119(e) of U.S. Provisional Application Ser. No. 60/417,533, filed Oct. 10, 2002.

FIELD OF THE INVENTION

The present invention relates to a resealable container and lid assembly having a lip snap seal for storing and packaging moisture-sensitive items, including but not limited to edible breath-freshening strips, drug-delivery strips, diagnostic test strips, and effervescent tablets.

SUMMARY OF THE INVENTION

The present invention relates to a resealable container and lid assembly having a lip snap seal for storing and packaging moisture-sensitive items, including but not limited to edible breath-freshening strips, drug delivery strips, diagnostic test strips, and effervescent tablets.

The container assembly substantially prohibits the ingress of moisture into the container assembly through the lid when the container is sealed. In other words, it is substantially moisture-proof. In another aspect of the invention, the container assembly is provided with a desiccant or similar material, which reduces the moisture present within the container when it is sealed. That is, after the container has been sealed, the desiccant absorbs moisture present therein. Likewise, after the container has been opened and then resealed, the desiccant absorbs moisture that entered the cavity when the container was opened.

In one embodiment of the present invention, the assembly comprises a lid and container that may be attached by a hinge. The hinge has a recess. The recess forms two elements, the first element being attached to the lid portion and the second element being attached to the container portion. In still a further embodiment, the recess functions as a bending point during the opening and closing of the container assembly.

The container has a sidewall extending downwardly from a top container surface. A bottom container surface is joined to the sidewall. The top container surface is provided with an opening, permitting acces to the interior of the container. The opening is bounded by a lip that extends upward from the top container surface. A rim is positioned on the outside of the upper end of the lip.

In one example, the lid portion of the assembly is attached to the container portion by a hinge. The lid portion has a base portion with an outer periphery that extends over the container portion. In one embodiment, a portion of the base portion serves as a tab for facilitating the opening and closing of the container assembly. In yet another embodiment, the base portion is provided with a skirt that extends downwardly from a central portion of the base portion. The skirt is positioned at a location on the base portion that allows the skirt to enter into a closing relationship with lip of the container portion, in which the skirt of the base portion fits over the periphery of the lip provided on the top container surface (or, as the case may be, the skirt fits within the periphery of the lip). The skirt of the base portion has an end distal to where the skirt joins the lid portion. At the distal end of the skirt, the skirt is provided with an inward extension, which extends around the interior periphery of the skirt. Similarly, the lip of the container portion is provided with an end distal to where the lip joins the container portion, and the distal end of the lip is provided with an outward facing extension, which extends around the periphery of the lip. In effect, the extension on the skirt and the extension on the lip face each other. In constructing this arrangement on the skirt and lip, the extensions will abut and interlock with each other when the lid is closed on the container portion. In this arrangement, the interlocking, abutting extensions will form at least a substantially moisture-tight sealing arrangement with each other.

In yet another embodiment, the lid and/or container contain a desiccant, in the shape of a disc (e.g., puck), sleeve, or other desired shapes.

In yet another embodiment, the skirt extending downward from the base portion has a distal end that is provided with an inward extension. The lip has an end distal to the location where the lip joins the container top surface, where the recess is positioned. The recess is adapted to receive the extension when the lid portion is closed upon the container portion.

In a further embodiment, the container assembly of the present invention is formed of a plastic material, by injection molding or other suitable molding techniques. For example, the assembly may be molded of polypropylene. The assembly comprises a base and an upper housing that can be molded separately, the base can be loaded with the item to be retained in the container, and then the base and upper housing can be snap-fit together employing a lip seal in order to provide moisture-tightness.

In one embodiment, the containers of the present invention have a relatively small height dimension, making them well adapted to fit in a handbag, purse, or pocket. Despite this small height dimension, the container is well suited to storing items such as candies, edible breath-freshening strips, and diagnostic test strips, such as those employed in testing blood glucose levels.

In yet another embodiment, the opening of the container is irregular in its shape, not having a uniform radius. In other words, it is not circular.

BRIEF DESCRIPTION OF THE DRAWINGS

FIGS. 12A to 12N illustrate views of yet another embodiment of the present invention.

DETAILED DESCRIPTION OF THE EMBODIMENTS

The present invention relates to a container and lid assembly for storing and packaging moisture-sensitive items, including but not limited to edible breath-freshening strips, drug-delivery strips, diagnostic test strips, and effervescent tablets, that substantially prohibits the ingress of moisture into the assembly through the lid when the container and lid are sealed.

In one embodiment, the assembly 10 is generally provided with a lid portion 12 and container portion 14 that are attached by a hinge 16. The hinge 16 has a recess 16'. The recess 16' forms two elements, the first element being attached to the lid portion and the second element being attached to the container portion In still a further embodiment, the recess functions as a bending point during the opening and closing of the container assembly.

Figure 10:
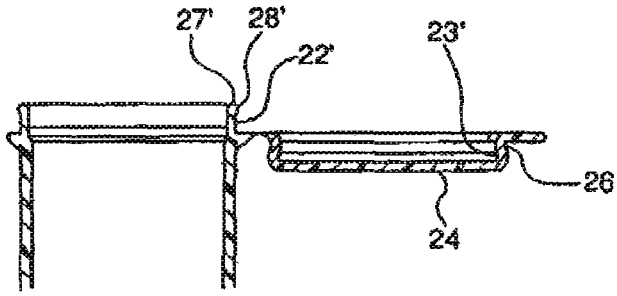
FIG. 10 is a cross sectional view of another embodiment of a container of the present invention.
Figure 11:
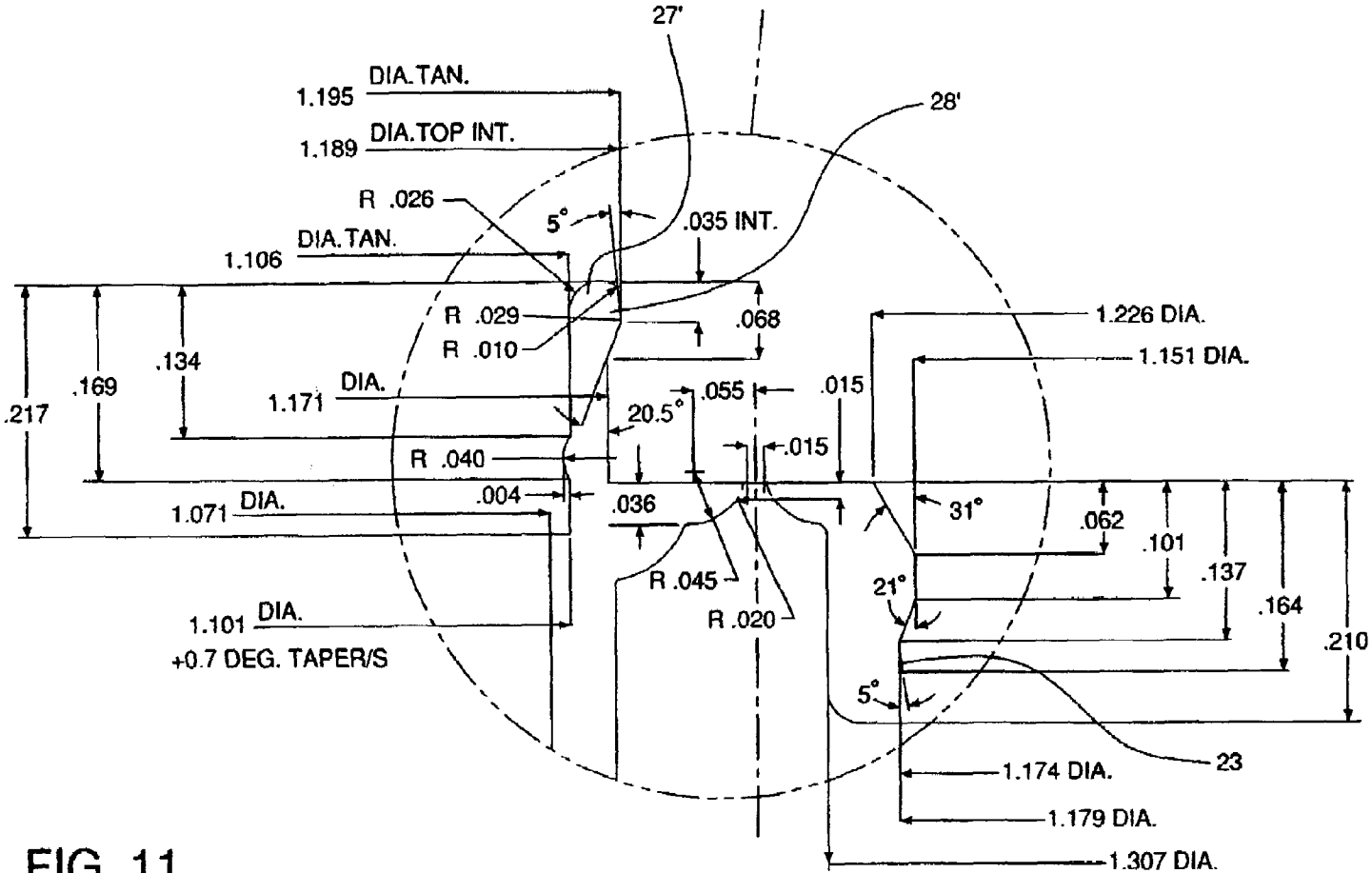
FIG. 11 is a perspective view showing features of the embodiment of FIG. 10.

In yet another embodiment, shown in FIGS. 10 and 11, the structure of the lip 22' has a distal end 27' provided with an extension 28'. The skirt 26' has a recess 23' positioned near where the skirt extends from the base portion 24'. The recess 23'is adapted to receive the extension 28' when the lid portion is closed upon the container portion. When the lid portion is closed on the container portion, the abutting arrangement between the lip and the skirt, and presence of the extension within the recess, forms a substantially moisture tight seal. FIG. 11 shows the configuration for such an arrangement.

Figure 1:
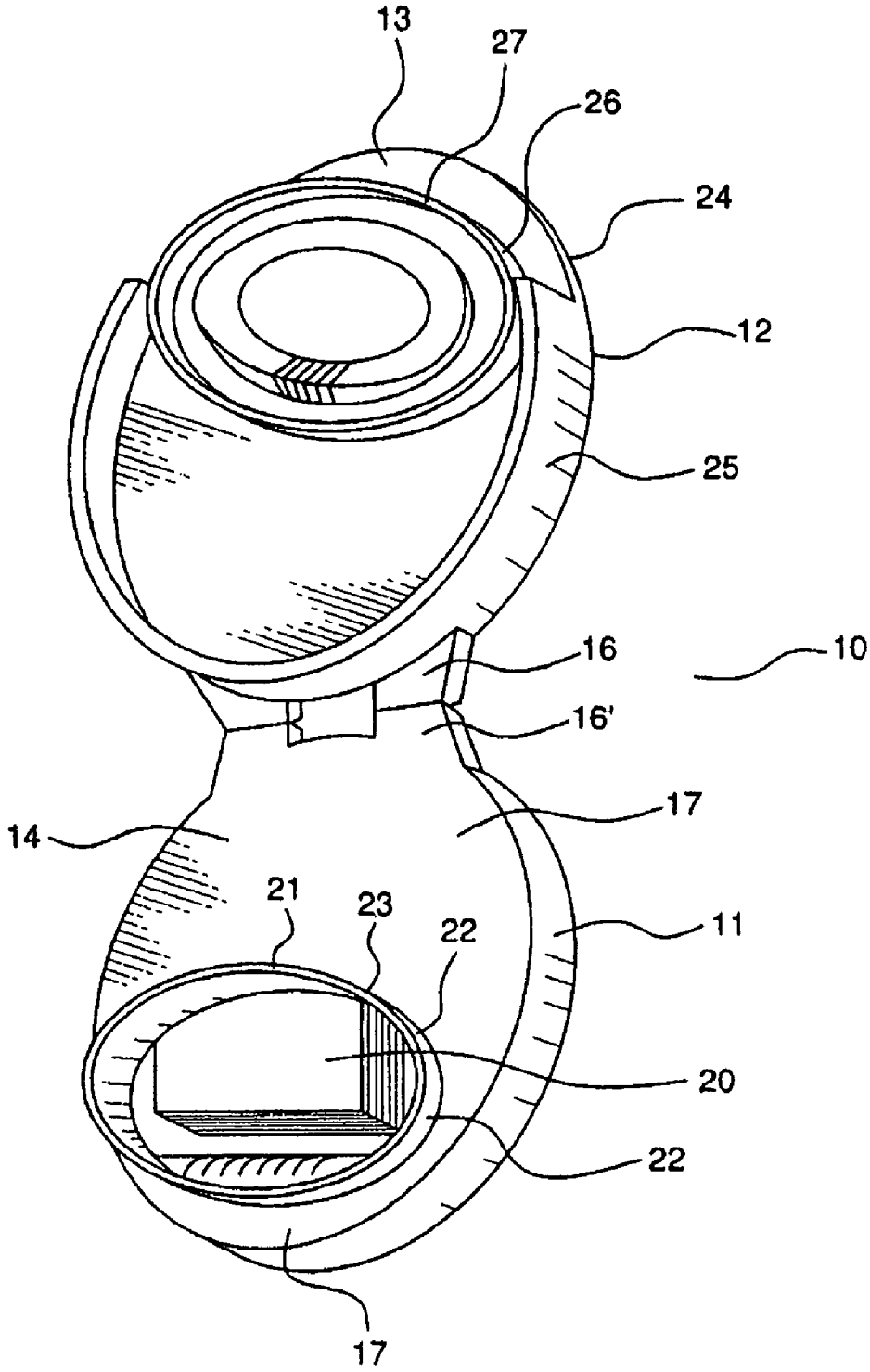
FIG. 1 is a perspective view of a container of the present invention.
Figure 3:
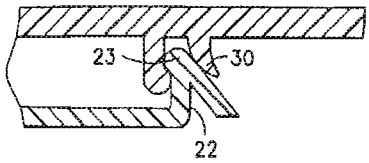
FIG. 3 is a side elevational view of a lip seal for a container of the present invention.
Figure 4:
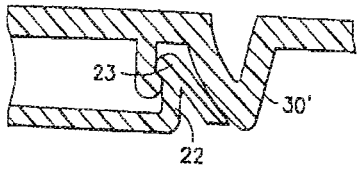
FIG. 4 is a side elevational view of another lip seal for a container of the present invention.
Figure 2:
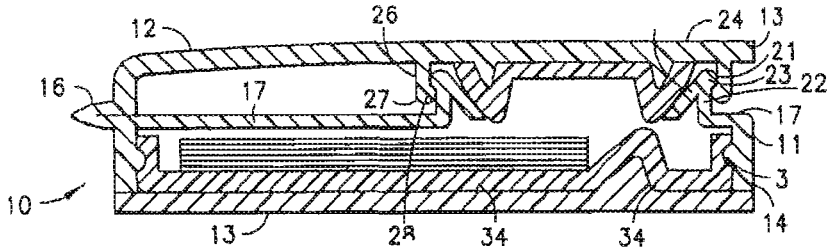
FIG. 2 is a cross sectional view of a container of the present invention.
Figure 5:
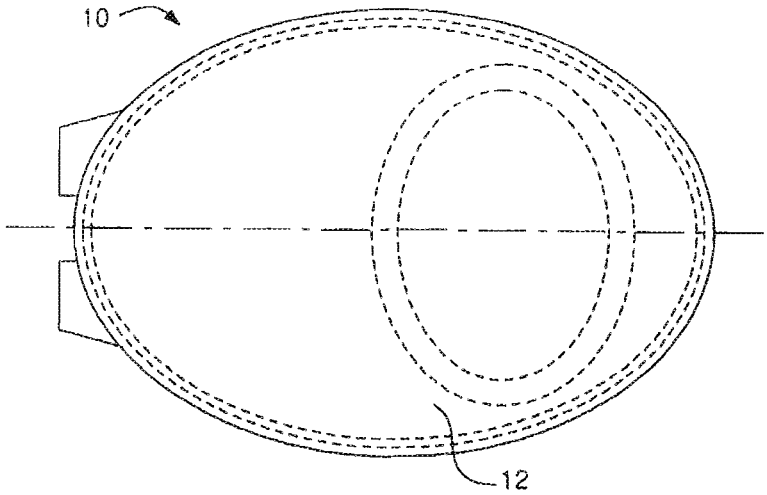
FIG. 5 is a top plan view of a container of the present invention.
Figure 6:
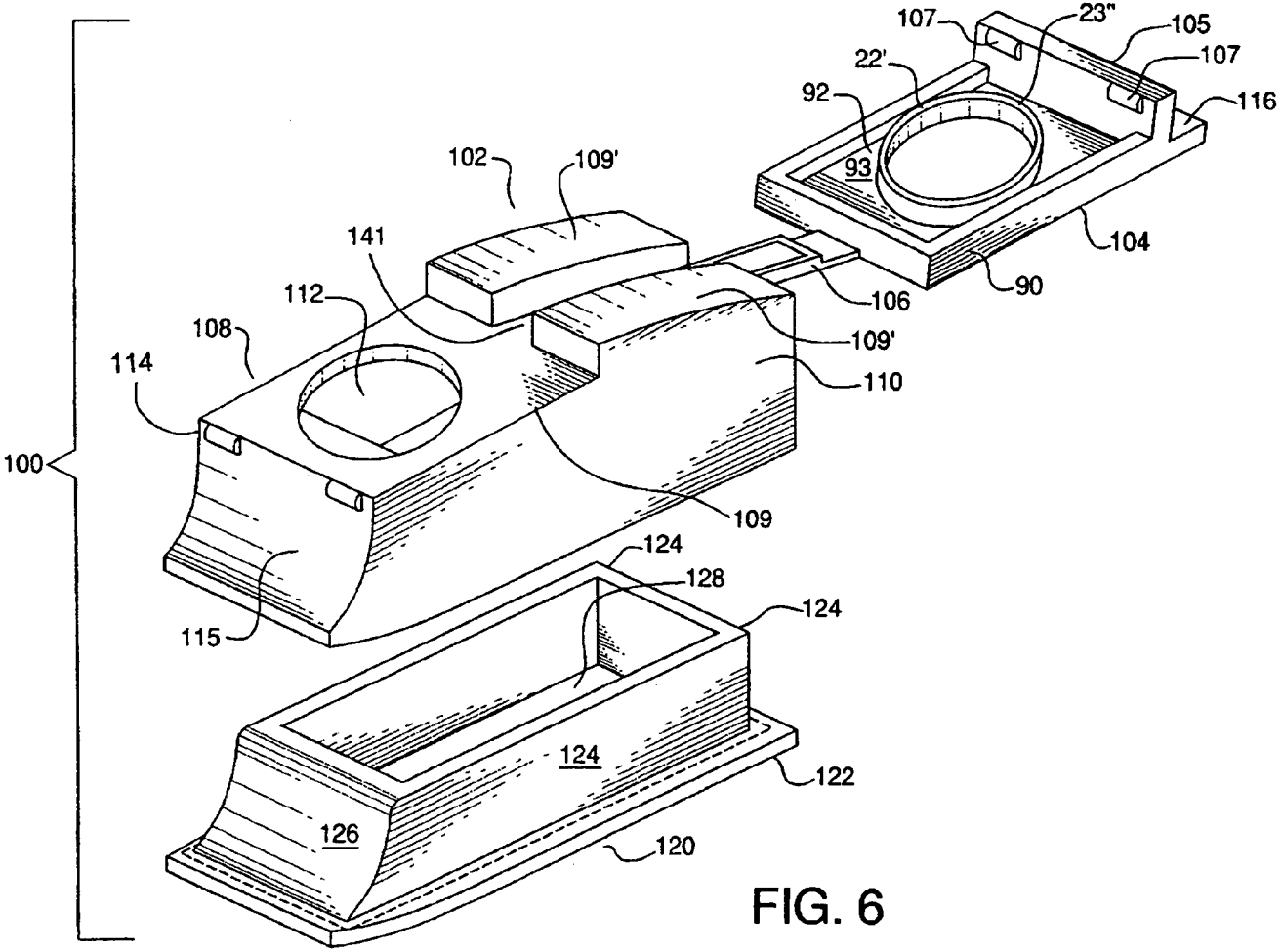
FIG. 6 is an exploded view of a container of the present invention.

In yet another embodiment, the lid and/or container contain a desiccant, in the shape of a disc (e.g. puck), sleeve, or other shapes. In one embodiment, a desiccant entrained plastic is located in a desiccant liner that covers at least a portion of the lid and/or container, such as the desiccant-entrained plastic sleeve 34 positioned at the bottom of the container. See FIG. 2, where the sleeve 34 is shown surrounding the item stored within the container on three of the item's sides. In one embodiment, such a sleeve or liner can surround the stored item(s) on more or less than three sides. See, e.g., FIG. 7, where the desiccant insert is positioned on the container base.

The desiccant-entrained plastic contains a desiccant such as silica gel or molecule sieve as the desiccant. Depending on the application, such as the application intended by the end user, molecule sieve or silica gel desiccant can be provided in the sleeve. For example, molecule sieve can be used for applications that require a low RH (e.g. less than <10%RH) maintained over the shelf life. In another example, silica gel can maintain a RH of 10-30% over a two year shelf life.

Suitable desiccant entrained plastic include, but are not limited to, these desiccant plastics disclosed in U.S. Pat. Nos. 5,911,937, 6,214,255, 6,130,263, 6,080,350 and 6,174,952, 6,124,006, and 6,221,446. These references are incorporated herein by reference. By varying the desiccant loading and channeling agent in the plastic formulation, the overall moisture capacity and uptake rate of the desiccant entrained plastic can be controlled. In embodiments where containers include desiccant material, they may be formed by two shot molding techniques.

The containers of the present invention are formed of plastic materials, by injection molding or other suitable molding techniques. For example, the containers may be molded of polypropylene. In one embodiment, the containers can be formed as a single closed unit, with the hinge joining the lid portion to the container portion.

In yet another embodiment, the container assembly comprising the base and upper housing portion can be molded separately. As such, in one example, the base portion can be loaded with the item(s) to be retained in the container assembly, and then the upper housing portion can be snap-fit with the base by employing a lip seal mechanism in order to provide moisture-tightness. Consequently, the container and lid assembly can be fit together, and the parts joined without the need for additional sealing methods, e.g., by welding (such as by sonic welding or by thermal welding).

Figure 14:
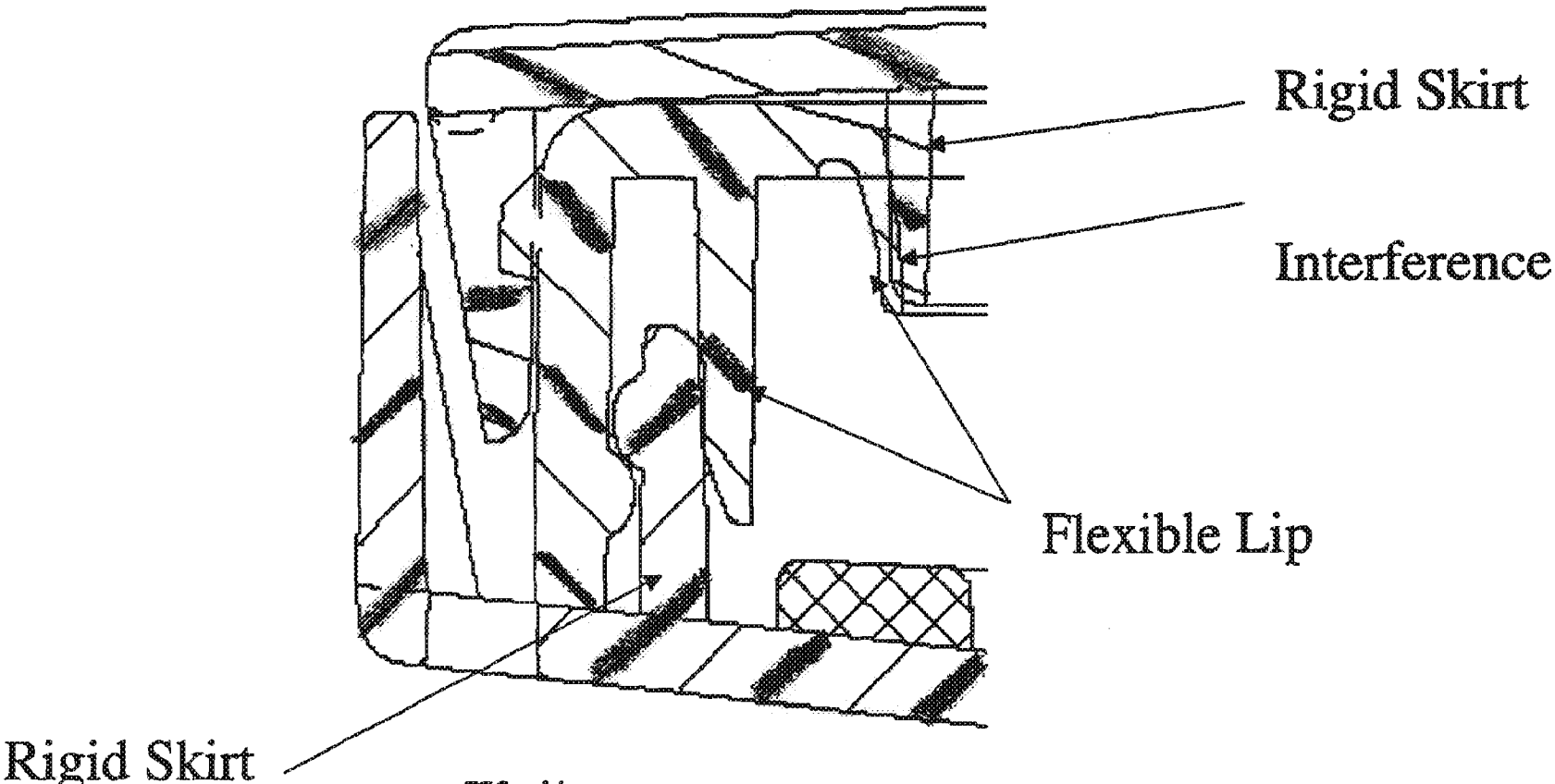
FIG. 14 is a cross-sectional view of an enlarged section of one end of the base and upper housing assembly illustrating the snap lip seal.

FIG. 14 illustrates one embodiment of the container assembly having a snap-fit by employing a lip seal mechanism. In FIG. 14, a lip seal member 300 of the upper housing portion extends downwardly and extends around the inside of the base portion. The lip seal member 300 is positioned interior to a skirt which also extending downwardly from the upper housing portion. Further, the lip seal member 300 is positioned to lie interior of a lip that extends upward from the base portion, and abut the interior side of the distal end of the lip, when the base portion is snap sealed with the upper housing portion. In one example, the lip seal (1) provides a sealing position, in addition to the one between the skirt and the lip; and (2) applies pressure on the lip from the inside out, which in turn applies pressure on the skirt, thereby applying tightening the seal between the skirt and the lip.

In a further embodiment of the lip seal mechanism, lip seal mechanism is designed to be sufficiently deflective so as to assist in the formation of a seal. As examples, the design of degree of deflection of the flexible lip can include, but is not limited to, the composition of the flexible lip (e.g. type of plastic), the thickness of the flexible lip, the curvature of the flexible lip, the length of the flexible lip and/or any attachments to the flexible lip.

In a further embodiment, the lid and container can be formed in a single piece (for example, joined at the hinge), yet open, as in a clamshell arrangement. The assembly can be filled with contents, closed shut, and then joined, e.g., welded to form a seal, as described above.

Figure 7:
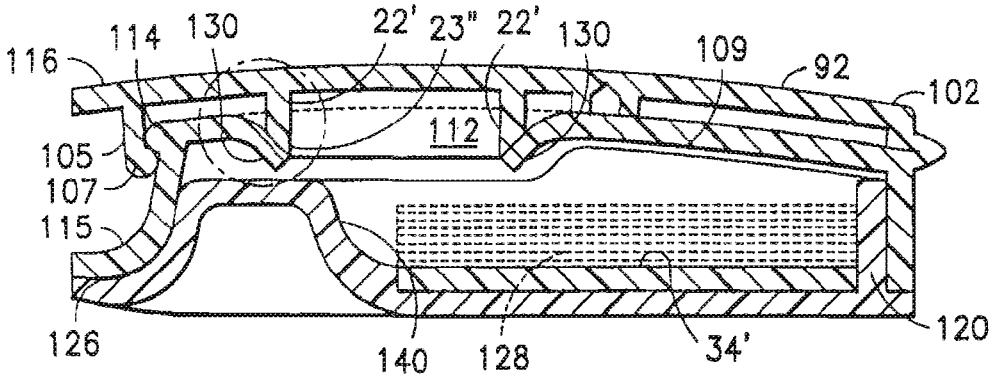
FIG. 7 is a cross sectional view of a container of the present invention.
Figure 7A:
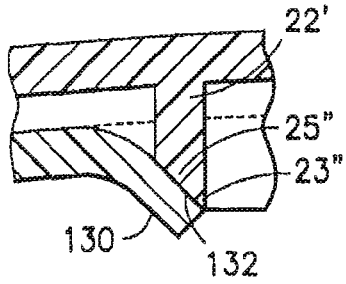
FIG. 7A is a perspective view of a feature shown in the FIG. 7 embodiment.

An embodiment depicting a two-part assembly is illustrated in FIGS. 6 to 9 and 12. In this embodiment, assembly 100 is provided with cover component 102 and tray component 120. The cover component 102 has a lid portion 104 that is joined to upper component 108 by hinge 106. As shown, lid portion 104 has sidewalls 90 located at the periphery of the lid base 92. The hinge 106 is joined to one of the sidewalls 90. Within the space of the sidewalls, the underside of the lid base 92 has a recess 93 in which the lip 22", extending from the lid base 92, is located. As shown in FIG. 7, the lip 22", which extends in a loop around a portion of the lid base 92, is positioned to be received in the opening 112 of upper component 108, when the lid portion is closed on the opening 112. The lip 22" is provided with an end 23" distal to where the lip 22" is joined to the lid base 92. As best seen in FIG. 7A, the distal end 23" of lip 22" has a tapered edge 25", which is adapted to lie substantially flush against the surface 132 of the edge 130, when the lip 22" of the lid portion 104 is closed on the opening 112 of the upper component 108. Thus, when the lid portion 104 is closed on the opening 112 of the upper component 108, the tapered edge 25"of the lip 22"lies substantially flush against the flexible edge 130 surrounding the opening 112 in the top surface 109 of the cover component 102.

Upper component 108 has top wall 109 from which sidewalls 110 and sloped wall 115 depend downward. Opening 112 is provided in the top wall 109. In the embodiment relating to hooks, hooks configured to mate with and compliment the hooks 107 on the lid portion 104 are positioned at one end of the upper component 108. At the end opposite where the hooks are positioned, hinge 106 is joined to the upper component 108. The upper component may have a recess 111 for the hinge 106, positioned between elevated portions 109' of top wall 109.

The tray component 120 is provided with sidewalls 124 and sloped wall 126 extending upward from the base of the tray 122. Sloped wall 126 is complimentary in its shape to the sloped wall 115 of the upper component 108. The sidewalls define a cavity 128 where items can be stored.

As best seen in FIG. 7, the edges 130 of the opening 112 provided in the top wall 109 are formed of a flexible plastic material that slopes downward, into the opening 112. The edges extend around the periphery of the opening 112.

Again, seen in FIG. 7A, the distal end 23" of lip 22" has a tapered edge 25", which is adapted to lie flush against the surface 132 of the edge 130, when the lip 22" of the lid portion 104 is closed on the opening 112 of the upper component 108. Thus, when the lid portion 104 is closed on the opening 112 of the upper component 108, the tapered edge 25" of the lip 22" lies flush against the flexible edge 130 surrounding the opening 112 in the top surface 109 of the upper component 108, thereby sealing the opening from substantial moisture ingress.

In the closed position (FIG. 7), hooks 107, 114, provided on the lid portion 104 and the upper component 108, respectively, are engaged with each other, to maintain the lid portion 104 closed on the upper component 108.

The cover component 102 is adapted to fit over the tray component 120, in order to form a container assembly. The cover component and the tray component can be loaded with items to be dispensed through the opening and then joined together, in the ways previously described herein.

Figure 8:
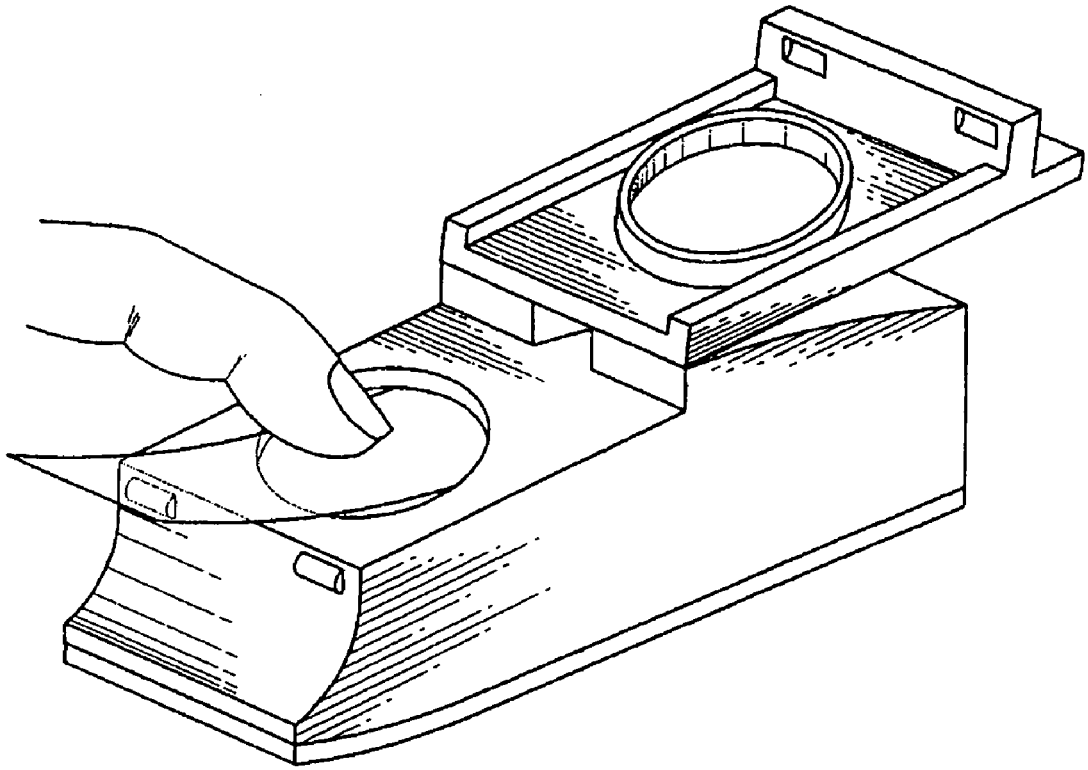
FIG. 8 is a perspective view of a container of the present invention, as an item is removed from the container.

As seen in FIG. 7, a stack of items is positioned in the container. Opening 112 is sized to permit a person to insert at least a portion of his or her finger therein. As shown in FIG. 8, a person can slide a portion of the index finger inside the hole, sliding an item up the sloped wall of the cavity 128 (FIG. 7), and through the opening.

A desiccant material, such as a desiccant sleeve, can be positioned in the container. As shown in FIG. 7, the sleeve 34' may be positioned along the base 122 of the tray component, or anywhere else along the interior of the assembly, where the item(s) is stored.

Figure 9:
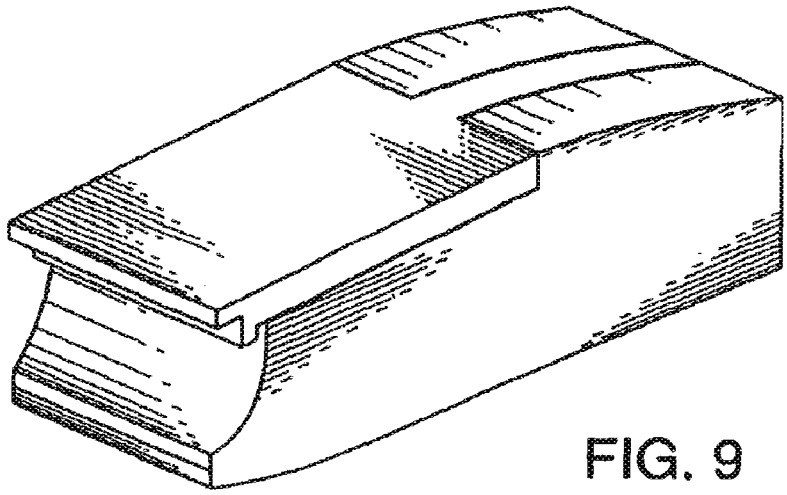
FIG. 9 is a perspective view of a container of the present invention in the closed position.

FIG. 9 shows the assembly in the closed position. It will be readily appreciated that the assembly is relatively compact, and will fit within a purse, handbag, or pocket, without taking up an undesired amount of space.

FIGS. 12A-12N show various views of another embodiment of a container assembly. Features of this embodiment are similar to the features of the embodiment depicted in FIGS. 6-9, with some differences as described here. The shape of the opening is asymmetrical. Also, the cover component 102 has a two hinge arrangement. Hinge 106 is as described above. Hinge 206 joins the first and second lid portions 104A and 104B. The lip of the lid portion is located on component 104B. Lid portion 104B is provided with tabs 208 that depend downward therefrom. Tabs 208 are sized and positioned to be received in recess 210 located on the top wall 109, and are received therein when the lid portion 104B is closed upon the top wall 109. In one embodiment, lid portion 104B may never be opened again, once it has been closed as described herein. The lid portion 104A is opened and shut at hinge 206.

Figure 13B:
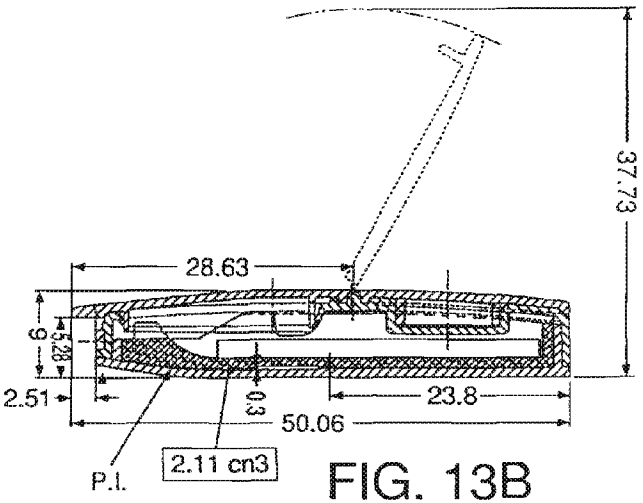
FIGS. 13A to 13E illustrate views of yet another embodiment of the present invention.
Figure 13C:
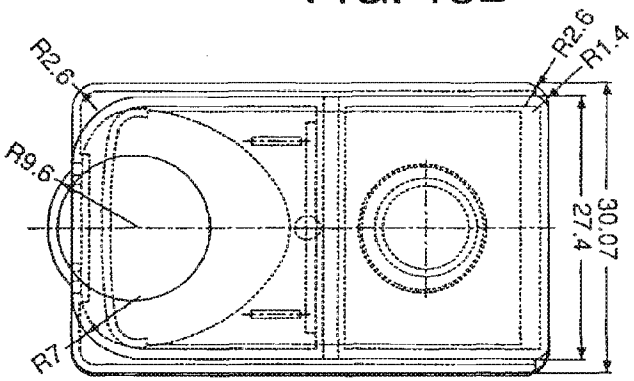
Figure 13A:
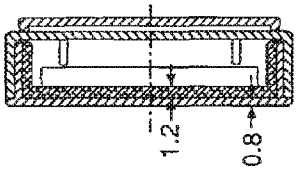
Figure 13E:
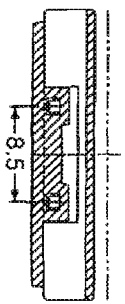
Figure 13D:
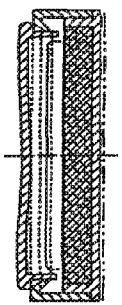

FIGS. 13A-12E show various views of yet another embodiment of a container assembly. Features of this embodiment are similar to the features of the embodiment depicted in FIGS. 1-5 and 6-9. As shown, the shape of the opening is asymmetrical. Also, the lid component has a one hinge arrangement. The hinge joins the lid to a portion of the container. In use, the lid portion is opened and shut at the hinge with the lid. In one example of constructing the assembly, the container base is made of two material—at least a portion of the interior of the base is composed of a desiccant entrained plastic and the remaining portion of the base is composed of a substantially water impermeable plastic (e.g. polypropylene, polyethylene). The lid is welded (e.g. ultrasonic welding) to the lid portion. After the container is filled with the desired material, the lid is joined to container (e.g. ultrasonic welding). The result is a moisture tight container.

At least some or all of the embodiments of the present invention can be molded according to techniques disclosed in U.S. Pat. Nos. Re 37,676 (a reissue of U.S. Pat. No. 5,723,085), U.S. Pat. No. 4,812,116, and U.S. Pat. No. 4,783,056, all of which are incorporated herein by reference.

In another embodiment, the present invention relates to moisture-tight and resealable container and lid assembly. The term "resealable" means that the lid of the container can be opened/reopened and closed/reclosed a numerous amount of times (e.g. more than 10 times) and still retain its moisture-tight properties. As used herein, the terms "moisture-tight" and "moisture-sensitive" mean the moisture ingress of the container (after three days) was less than about 1500 micrograms of water, in another embodiment, about 500 micrograms of water, in a further embodiment, about 300 micrograms of water, in yet another embodiment, about 150 micrograms of water determined by the following test method: (a) place one gram plus or minus 0.25 grams of molecular sieve in the container and record the weight; (b) fully close the container; (c) place the closed container in an environmental chamber at conditions of 80% relative humidity and 72 F.; (c) after one day, weigh the container containing the molecular sieve; (d) after four days, weigh the container containing the molecular sieve; and (e) subtract the first day sample from the fourth day sample to calculate the moisture ingress of the container in units of micrograms of water.

What is claimed is:

1. A substantially moisture tight container and lid assembly for storing and packaging moisture-sensitive items comprising:

an assembly with a container and a lid, a) the lid is attached by a hinge to an upper housing portion of the container, the lid has an outer periphery that extends over at least a portion of the container, the lid is provided with a skirt that extends downwardly therefrom, b) the container has a container base, and a sidewall extending upwardly from the container base, i) a top of the container is provided with an opening that permits access to an interior of the container, wherein the opening is spaced away from an outer surface of the sidewall of the container, ii) the opening of the top of the container is bounded by a lip that extends upward from the top of the container, the lip of the top of the container extends around the periphery of the opening of the top of the container, iii) the skirt of the lid is positioned at a location on the lid that allows the skirt of the lid to enter into a closing relationship with the lip of the top of the container, wherein the skirt of the lid fits over a periphery of the lip of the top of the container, iv) the lid further includes a flexible lip seal member that extends downwardly therefrom, the flexible lip seal member of the lid is configured to abut at least a portion of the interior side of the lip of the top container surface when the lid is in the closed position, wherein the flexible lip seal member is designed to be sufficiently deflective so as to provide a sealing position, in addition to the closing relationship between the skirt of the lid and the lip of the top container when the lip of the top of the container applies pressure on the flexible lip seal member from the outside in, which in combination with the closing relationship between the skirt of the lid and the lip of the top of the container results in a substantially moisture tight seal between the lid and the container, and wherein the skirt of the lid includes an inwardly facing extension, the lip of the top of the container includes an outwardly facing extension, the inwardly facing extension of the skirt of the lid and the outwardly facing extension of the lip abut and interlock with each other in a snap-fit configuration when the lid is in the closed position.

2. The substantially moisture tight container and lid assembly of claim 1 wherein a portion of the lid serves as a tab for facilitating the opening and closing of the container assembly.

3. The substantially moisture tight container and lid assembly of claim 1 wherein at least a portion of the interior of the container base is composed of a desiccant entrained plastic.

4. The substantially moisture tight container and lid assembly of claim 1 wherein container and lid assembly is resealable.

5. The substantially moisture tight container and lid assembly for storing and packaging moisture-sensitive items of claim 1 wherein the degree of deflection of the flexible lip is determined, at least in part, by the thickness of the flexible lip and the curvature of the flexible lip.

6. A substantially moisture tight container and lid assembly for storing and packaging moisture-sensitive items comprising:

an assembly with a container and a lid, a) the lid is attached by a hinge to an upper housing portion of the container, the lid has an outer periphery that extends over at least a portion of the container, the lid is provided with a skiff that extends downwardly therefrom, b) the container has a container base, and a sidewall extending upwardly from the container base, i) a top of the container is provided with an opening that permits access to an interior of the container, wherein the opening is spaced away from an outer surface of the sidewall of the container, ii) the opening of the top of the container is bounded by a lip that extends upward from the top of the container, the lip of the top of the container extends around the periphery of the opening of the top of the container, iii) the skirt of the lid is positioned at a location on the lid that allows the skiff of the lid to enter into a closing relationship with the lip of the top of the container, wherein the skirt of the lid fits over a periphery of the lip of the top of the container, iv) the lid further includes a lip seal member that extends downwardly therefrom, the lip seal member of the lid is configured to abut at least a portion of the interior side of the lip of the top of the container when the lid is in the closed position, wherein the lip seal member provides a sealing position, in addition to the one between the skirt of the lid and the lip of the top of the container, and applies pressure on the lip of the top of the container from the inside out, which in turn applies pressure on the skirt of the lid, thereby tightening the seal between the skirt of the lid and the lip of the top of the container, resulting in a substantially moisture tight seal between the lid and the container, and wherein the skirt of the lid includes an inwardly facing extension, the lip of the top of the container includes an outwardly facing extension, the inwardly facing extension of the skirt of the lid and the outwardly facing extensions of the lip abut and interlock with each other in a snap-fit configuration when the lid is in the closed position.

7. A substantially moisture tight container and lid assembly for storing and packaging moisture-sensitive items comprising:

an assembly with a container and a lid, a) the lid is attached by a hinge to an upper housing portion of the container, the lid has an outer periphery that extends over at least a portion of the container, the lid is provided with a skirt that extends downwardly therefrom, b) the container has a container base, and a sidewall extending upwardly from the container base, i) a top of the container is provided with an opening that permits access to an interior of the container wherein the opening is spaced away from an outer surface of the sidewall of the container, ii) the opening of the top of the container is bounded by a lip that extends upward from the top of the container, the lip of the top of the container extends around the periphery of the opening of the top of the container, iii) the skirt of the lid is positioned at a location on the lid that allows the skirt of the lid to enter into a closing relationship with the lip of the top of the container, wherein the skirt of the lid fits over a periphery of the lip of the top of the container, iv) the lid further includes a flexible lip seal member that extends downwardly therefrom, the flexible lip seal member of the lid is configured to abut at least a portion of the interior side of the lip of the top of the container when the lid is in the closed position, wherein the flexible lip seal member is designed to be sufficiently deflective so as to provide a sealing position, in addition to the closing relationship between the skirt of the lid and the lip of the top of the container when the lip of the top of the container applies pressure on the flexible lip seal member from the outside in, which in combination with the closing relationship between the skirt of the lid and the lip of the top of the container, wherein the closing relationship between the skirt of the lid and the lip of the top of the container and the flexible lip sealing member that provides a sealing position results in a substantially moisture tight seal between the lid and the container, and wherein the skirt of the lid includes an inwardly facing extension, the lip of the top of the container includes an outwardly facing extension, the inwardly facing extension of the skirt of the lid and the outwardly facing extensions of the lip abut and interlock with each other in a snap-fit configuration when the lid is in the closed position.

* * * * *